US005836484A

United States Patent [19]

Gerber

[11] Patent Number: 5,836,484

[45] Date of Patent: Nov. 17, 1998

[54] CONTAMINATION-SAFE MULTIPLE-DOSE DISPENSING CARTRIDGE FOR FLOWABLE MATERIALS

[76] Inventor: Bernard R. Gerber, 583 Mello La., Santa Cruz, Calif. 95062-2707

[21] Appl. No.: 724,975

[22] Filed: Oct. 3, 1996

[51] Int. Cl.[6] ..... B65D 5/72

[52] U.S. Cl. ..... 222/494; 604/213

[58] Field of Search ..... 222/107, 494; 604/247, 213; 137/853

[56] References Cited

U.S. PATENT DOCUMENTS

| | | | |
|---|---|---|---|
| 2,715,980 | 8/1955 | Frick . | |
| 4,846,810 | 7/1989 | Gerber | 222/494 X |
| 5,080,138 | 1/1992 | Haviv | 222/494 X |
| 5,092,855 | 3/1992 | Pardes | 222/494 X |

FOREIGN PATENT DOCUMENTS 2106480 4/1983 United Kingdom .

*Primary Examiner*—Gregory L. Huson

[57] ABSTRACT

A dispensing cartridge is designed to dispense multiple doses of a flowable material from a collapsible container, i.e., from a container of the type which does not produce an internal vacuum as the flowable material is dispensed. The cartridge has a housing for protecting a delivery block enveloped by an elastic sheath. The delivery block receives the flowable material from the collapsible container through an input port and delivers it through an internal channel with branches to at least one output port. Sleeve valves are created at the output port or ports by the sheath. In a preferred embodiment an end of the sheath forms an outlet valve downstream of the sleeve valves. The cartridge prevents external contaminants such as air and its constituents, oxygen, nitrogen, water vapor and other atmospheric gases as well as other air-borne contaminants including smoke, dust, pollen and microorganisms from entering the container and can be mounted on tubes, bags, infusion containers, syringes, pouches, collapsible reservoirs, bellows-type containers and the like. In a particularly advantageous embodiment the dispensing cartridge is permanently bonded to the container to produce an integrated dispensing system.

39 Claims, 5 Drawing Sheets

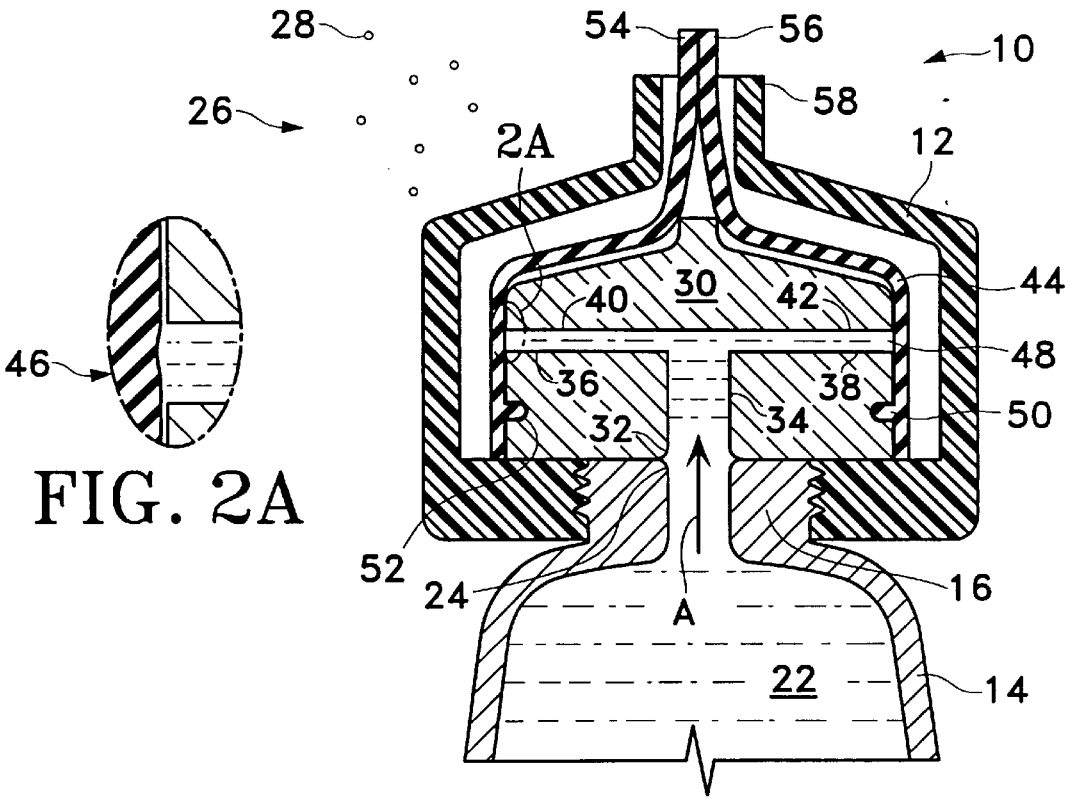
FIG. 2A
FIG. 2
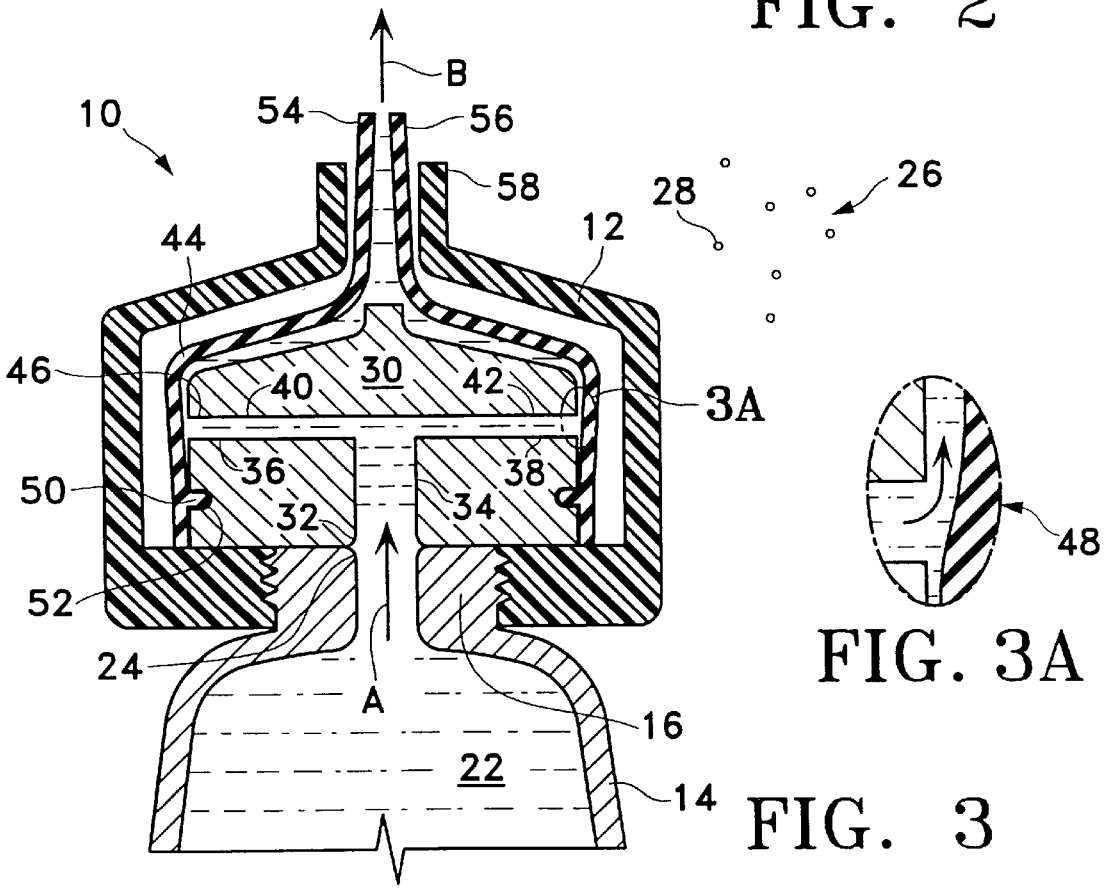
FIG. 3A
FIG. 3

CONTAMINATION-SAFE MULTIPLE-DOSE DISPENSING CARTRIDGE FOR FLOWABLE MATERIALS

BACKGROUND OF THE INVENTION

The field of the invention relates generally to dispensing devices for delivering flowable materials such as liquids, solutions, dispersions, suspensions, gels, pastes and other fluids. More particularly, the field of the invention relates to a dispensing system for delivering multiple doses of flowable materials and for preventing the influx of external contaminants during and between deliveries.

The dispensing of flowable materials in a contamination-safe manner, especially over prolonged periods of time or in a repetitive manner, e.g., in multiple doses, presents many difficulties. The main problems relate to precise flow control and prevention of back flow or reflux. In fact, external contaminants easily can enter a container with the back flow at the end of the delivery cycle.

Most collapsible containers for flowable materials have a discharge port such as a hole, nozzle, spout or other type of opening. The contents such as pastes, liquids or other fluids exit through the discharge port propelled by internal pressure.

This method of dispensing the flowable material is frequently inaccurate and does not prevent the entry of external contaminants into the container. Hence, additional pouring or dispensing devices are surmounted on the discharge port when precise control of the dispensing characteristics is desired. These devices must be simple, effective and low-cost, especially if intended for widespread commercial and domestic use.

Typically, a dispensing apparatus has a valve mechanism to ensure precise delivery. In U.S. Pat. No. 5,033,655 Brown teaches how to dispense fluid products from a non-collapsible container by employing a system with a slit valve. The system admits air to prevent the collapse of the container as fluid is delivered to the user. Thus, external contaminants borne by air are forced into the solution remaining in the container. Clearly, such dispensing apparatus is not suitable for contamination-safe dispensing from collapsible containers.

A simple solution in the form of a squeeze valve with augmented sealing is presented by Vorhis in U.S. Pat. No. 5,265,847. This apparatus is adapted for containers whose contents are expelled under the force of gravity. In U.S. Pat. No. 5,099,885 Nilsson discloses a flapper valve, which delivers viscous fluids by means of a pump. This solution is not applicable to all types of liquids and fluids. Likewise, in U.S. Pat. No. 5,346,108 Pasinski discloses a gauged dispensing apparatus to deliver a predetermined amount of generally viscous fluid. The apparatus has a flexure with a bi-stable orientation, concave to convex. Airborne contaminants can enter the apparatus as the flexure returns to its original position. In addition to the shortcomings already mentioned, the above conventional solutions to the problem of preventing airborne contaminants from entering a flowable medium are not specifically designed to prevent back flow. Haviv teaches in his U.S. Pat. No. 5,080,138 a valve assembly relying on a sleeve valve and consisting of multiple components. Back flow is thwarted by a sheath which permits the flowable to flow out of the valve but prevents any back flow into the container. Unfortunately, this device is complicated, costly to manufacture and difficult to assemble.

A simple discharge nozzle is presented by Latham in U.S. Pat. No. 5,398,853. The nozzle is adapted for the delivery of pastes, e.g., toothpaste. Although Latham does attempt to eliminate the transfer of germs between the discharge opening and the secondary surface where the paste is applied, his nozzle will not arrest the influx of bacteria. For example, bacteria can enter when the nozzle is immersed in a solution.

More effective methods of contamination-free dispensing are disclosed in U.S. Pat. Nos. 5,305,786 and 5,092,855 issued to Debush and Pardes respectively. Debush discloses a modification to the applicant's prior U.S. Pat. No. Re. 34,243 relying on an expandable elastomeric sleeve tightly fitted about a valve body with entry and exit ports. Debush's improvement is aimed at simplifying the assembly. Unfortunately, his solution requires more material to manufacture the valve. In addition, it is difficult to produce a discoid-shaped valve for this invention and adapt the apparatus to collapsible containers. Pardes discloses a rigid enclosing sleeve to retain the elastomeric sheath against the valve body, thus providing a seal between the sheath and the valve body. This is closely related to the applicant's teaching in U.S. Pat. No. Re. 34,243. Pardes'valve operates through two sets of ports within a valve body, thus rendering the device unnecessarily complex.

None of the known conventional dispensing devices are low-cost, simple in construction and capable of delivering a flowable material ranging from low to high viscosity. Furthermore, conventional devices can not be easily adapted to collapsible containers, i.e., containers which do not produce an internal vacuum when their contents are expelled.

In view of the above discussion, what is needed is a contamination-safe multiple-dose dispensing cartridge for dispensing a flowable material from a collapsible container.

Furthermore, the dispensing cartridge of the invention should thwart the back flow or reflux of the flowable material. This will prevent external contaminants from entering the container through the dispensing cartridge during and after delivery of the flowable material.

What is also needed is a dispensing system which provides a contamination-safe cartridge that is simple in construction and easy to mount on various types of collapsible containers. Further aspects and advantages of the invention will be elucidated in the detailed description.

SUMMARY OF THE INVENTION

A multiple-dose dispensing cartridge is designed to dispense a flowable material from a collapsible container, i.e., from a container of the type which does not produce an internal vacuum as the flowable material is dispensed. The cartridge prevents external contaminants from entering the container by virtue of its construction. In particular, the cartridge has a housing and an attaching mechanism for attaching the housing to the delivery port of the container in an air-tight manner. A delivery block located inside the housing has an input port for receiving the flowable material exiting the container through the delivery port. An internal channel commencing at the input port and terminating in at least one output port runs through the delivery block. A flexible sheath envelops the delivery block such that a portion of the sheath covers the output port or ports to thus produce one or more sleeve valves permitting only the outflow of the flowable material from the output port or ports.

In a preferred embodiment the cartridge has an outlet valve formed by an end of the flexible sheath downstream of the one or more sleeve valves. The outlet valve also permits only the outflow of the flowable material. Typically, the outlet valve formed by the end of the sheath is a duck bill valve, a slit valve or a flapper valve. In another embodiment the outlet is formed by the end of the flexible sheath without creating an actual valve.

Finally, the cartridge of the invention has a dispensing port in the housing for dispensing the flowable material exiting from the outlet valve or outlet created by the flexible sheath.

The cartridge of the invention can be mounted on collapsible containers such as tubes, bags, infusion containers, syringes, pouches, collapsible reservoirs, bellows-type containers and the like. The attachment mechanism will depend on the type of container and may generally be constituted by an adhesive seal, a screw-on neck, a press-fit neck, a bonding seal, a heat seal or other joining material or element.

The housing is preferably made of a moldable material and is rigid. This is necessary to arrest the expansion of the flexible sheath and prevent abrasion of the sheath as the flowable material is being dispensed. The flexible sheath is preferably made of a moldable thermoplastic elastomer. Exemplary materials which can be utilized in making the sheath include styrene-butadiene styrene, silicone, urethane, rubber and the like. Furthermore, the sheath is affixed on the delivery block to prevent slip-off and ensure proper operation of the sleeve valve or valves. This can be accomplished with an O-ring and a corresponding groove formed in the delivery block or a protrusion in the sheath for fitting into an analogous groove in the delivery block. Alternatively, the sheath is pinched between the delivery block and the housing. In all cases, however, the inner diameter of the sheath in undistended state is smaller than the outer diameter of the delivery block. By virtue of this provision the sheath will fit tightly around the delivery block. The preferred range of inner diameters is 0.5 to 0.8 times the outer diameter of the delivery block.

The cartridge of the invention is effective in preventing the entry of air and its constituents, oxygen, nitrogen, water vapor and other atmospheric gases as well as other air-borne contaminants including smoke, dust, pollen and microorganisms. Thus, the contents of the collapsible container is protected from degradation due to these types of external contaminants. In a particularly advantageous embodiment of the invention, the dispensing cartridge can be permanently bonded to the container, e.g., by the manufacturer such that the container and cartridge constitute an integrated dispensing system.

The invention will now be explained in more detail with reference to the attached drawing figures.

DESCRIPTION OF THE FIGURES

FIG. 2 is a cross sectional view of the dispensing cartridge of FIG. 1 before delivery.

FIG. 2A is an enlargement of a portion of FIG. 2 as shown.

FIG. 3 is a cross sectional view of the dispensing cartridge of FIG. 1 during delivery.

FIG. 3A is an enlargement of a portion of FIG. 3.

DETAILED DESCRIPTION

Figure 1:
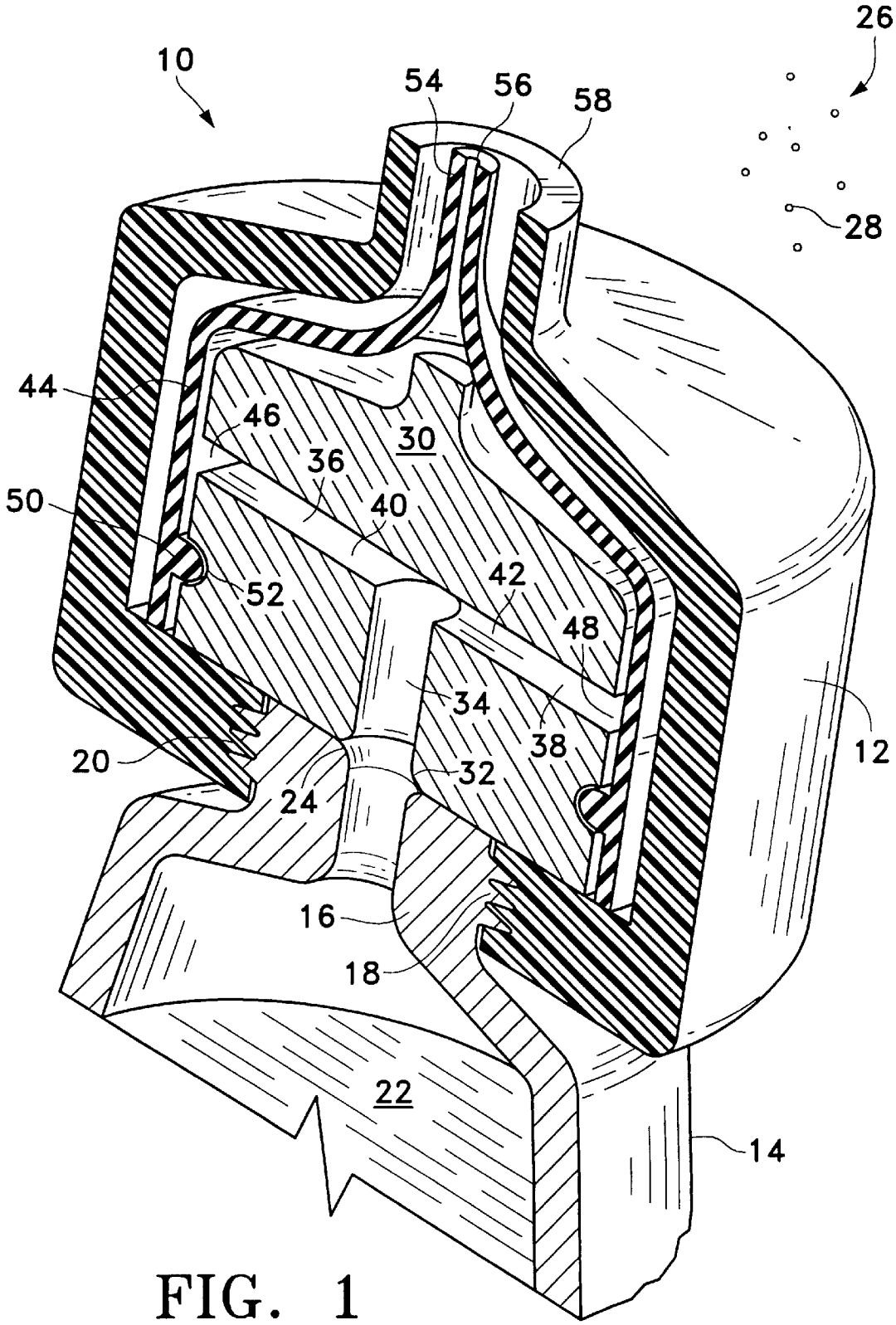
FIG. 1 is a three dimensional sectional view of a dispensing cartridge according to the invention.

A preferred embodiment of a dispensing cartridge 10 assembled in a housing 12 is shown in FIG. 1. Conveniently, housing 12 is made of a moldable material which is rigid and inert. In this case cartridge 10 is mounted on a collapsible container 14, of which only the top portion is shown. It should be noted that in the figure cartridge 10 is much larger than a neck 16 of container 14. In practice it will be oftentimes desirable to considerably reduce the dimensions of cartridge 10, e.g., to constitute a small extension of neck 16 or protrude into or be embedded in neck 16. In the embodiment shown neck 16 has a neck threading 18 which cooperates with a cartridge threading 20 on the lower portion of housing 12. Thus, cartridge 10 is mounted on container 14 in an air-tight manner by screwing housing 12 onto neck 16.

A flowable material 22 is stored in container 14. Typically, material 22 is a liquid or fluid which requires careful dispensing and protection from external contaminants 26. These contaminants 26 can be broken down into particulates or other matter 28 such as air and its constituents, oxygen, nitrogen, water vapor and other atmospheric gases as well as other airborne contaminants including smoke, dust, pollen and microorganisms. The last group consists of yeasts, molds, bacteria, protozoa and diverse viruses. Many flowable products, such as medicines, chemicals, health-care materials, personal hygiene materials, edibles and other flowable goods require protection from at least one of the above-listed contaminants 26. These products are encountered in domestic, commercial and industrial settings.

Neck 16 terminates in an opening or delivery port 24. Flowable material 22 exits container 14 through port 24 to enter dispensing cartridge 10. In particular, cartridge 10 has a delivery block 30 whose lower portion exhibits an input port 32 for receiving material 22. Delivery port 24 is pressed firmly and tightly against the bottom of delivery block 30 when cartridge 10 is mounted on container 14. In this way delivery port 24 feeds directly into input port 32.

Delivery block 30 has an internal channel 34 commencing at input port 32 and terminating in two output ports 36 and 38. In fact, channel 34 splits into two branches 40 and 42 leading to output ports 36 and 38 respectively. In this embodiment output ports 36 and 38 are arranged on diametrically opposite faces of delivery block 30. This geometrical placement of ports 36 and 38 is preferred because it is easily manufactured and ensures their largest circumferential separation.

A flexible sheath 44 stretches over or envelops delivery block 30. Preferably, the material of flexible sheath 44 is a moldable thermoplastic elastomer. Although a person with average skill in the art will be able to find other suitable elastics, the most preferred ones include styrene-butadiene styrene, silicone, urethane and rubber.

To ensure that sheath 44 fits tightly around delivery block 30, it is important that in the undistended state the inner diameter of sheath 44 be smaller than the outer diameters of block 30. This way, once sheath 44 is slipped over delivery block 30, it will stretch to tightly envelop delivery block 30. In fact, it has been determined that the inner diameter of sheath 44 in the undistended state should most preferably range from 0.5 to 0.8 times the outer diameter of delivery block 30. The taut fit around block 30 achieved at this diameter differential will ensure good operation of sleeve valves 46 and 48 described below.

Another provision for securing sheath 44 in place over delivery block 30 includes an inward bulge or protrusion 50 extending circumferentially around delivery block 30. Correspondingly, delivery block 30 has a groove 52 for receiving protrusion 50. Sheath 44 is securely fixed when protrusion 50 is lodged or seated in groove 52 along the circumference of delivery block 30. In other words, protrusion 50 serves the role of an attaching means for affixing sheath 44 to delivery block 30 below output ports 36 and 38.

When properly mounted, sheath 44 extends over the sides of delivery block 30 thus covering both output ports 36 and 38. This produces two sleeve valves 46 and 48 at the locations where ports 36 and 38 are covered. By their nature, sleeve valves 46 and 48 are one-way and operate when forced open by pressure at ports 36 and 38.

Downstream of sleeve valves 46 and 48 and generally above delivery block 30 sheath 44 constricts and terminates with an end 54. In fact, in the preferred embodiment illustrated in FIG. 1 end 54 of sheath 44 forms an outlet valve 56. The elastic material of sheath 44 narrows down to a thin neck, which is normally closed as the elastic material adheres to itself As a consequence, outlet valve 56 is a one-way, normally closed valve. In other words, outlet valve 56 will only permit the outflow of flowable material 22 when pressure causes the adhering walls at end 54 to open up outlet valve 56. A person with average skill in the art will appreciate that the exact geometry and parameters of outlet valve 56 can vary depending on the way the material of sheath 44 comes together. In general, this type of one-way valve is well known and encompasses three particular types: a duck bill valve, a slit valve and a flapper valve. Any one of these can be used as outlet valve 56.

Housing 12 has a dispensing port 58 in the form of a circular opening at the point of exit of outlet valve 56. Depending on the application, dispensing port may surround outlet valve 56 and protect end 54 of sheath 44 from contact with external objects. It is also possible for end 54 to protrude beyond the walls of dispensing port 58. This may be desirable if periodic cleaning of outlet valve 56 is anticipated.

The general shape of housing 12 is such as to conform to the shape of sheath 44 when delivering flowable material 22. That is because one of the functions of housing 12, besides general protection of the elements of cartridge 10 from the external environmental hazards, is to arrest the expansion of sheath 44. This is necessary to prevent sheath 44 from rupturing and to ensure proper flow delivery characteristics of flowable material 22.

The inner diameter of housing 12 is chosen to be greater than the outer diameter of delivery block 30 by an amount which depends on the desired rate of delivery of flowable material 22 from outlet valve 56. This choice will also take into consideration the viscosity of flowable material 22 and the elasticity and rupture point of sheath 44. Adequate doses of flowable material 22 are possible with expansion in the diameter of sheath 44 of as little as 500 $\mu$m. It will be obvious to one skilled in the art that smaller or larger expansions in the diameter of sheath 44 may be chosen in specific instances.

Additionally, housing 12 also protects sheath 44 from abrasion which could occur if housing 12 were absent as well as when flowable material 22 is being delivered. For this purpose, the internal walls of housing 12 are smooth.

The operation of dispensing cartridge 10 is best explained by FIGS. 2 and 3. In FIG. 2 cartridge 10 is disabled, although flowable material 22 is present in internal channel 34 and branches 40 and 42. In fact, as indicated by arrow A, flowable material 22 has passed through neck 16 and delivery port 24 into internal channel 34 through input port 32. Sleeve valves 46 and 48 at ports 36 and 38 are closed as sheath 44 tightly envelops delivery block 30. The magnified view of sleeve valve 46 shows flowable material 22 wetting sheath 44. Due to insufficient pressure, flowable material 22 is unable to open sleeve valve 46 or 48. Meanwhile, outlet valve 56 remains closed and there is no flowable material 22 downstream of outlet valve 56.

To activate cartridge 10, as shown in FIG. 3, pressure is exerted either on container 14 or on flowable material 22. The former can be accomplished by compressing container 14 by manual or mechanical means including a peristaltic pump and the latter by pumping or other internal means of pressure delivery. Under this pressure both sleeve valves 46 and 48 are forced open by flowable material 22. Sheath 44 expands as flowable material 22 fills the space downstream of sleeve valves 46 and 48. Meanwhile, housing 12 prevents excessive expansion of sheath 44 and its rupture or abrasion.

Next, the pressure of flowable material 22 trapped under sheath 44 opens outlet valve 56. Thus, flowable material 22 is dispensed as indicated by arrow B. As soon as the pressure of flowable material 22 drops below the minimum pressure necessary to keep open sleeve valves 46 and 48, the remaining flowable material 22 will be expelled through outlet valve 56. This will occur due to the pressure exercised by sheath 44 as it contracts back to snugly envelop delivery block 30.

This arrangement of sleeve valves 46 and 48 with outlet valve 56 in tandem is clearly advantageous. There is no back flow of flowable material 22 through either sleeve valve 46 or 48. All flowable material 22 remaining under sheath 44 is expelled through outlet valve 56. Thus, there is no back flow through outlet valve 56 either. As a result, the operation of dispensing cartridge 10 is contamination-safe. No particles 28 of external contaminants 26 can enter through outlet valve 56 and sleeve valves 46 or 48 to end up inside container 22.

The operation of dispensing cartridge 10 is the same during subsequent cycles, since all flowable material 22 trapped downstream of sleeve valves 46 and 48 will always be expelled through outlet valve 56. Dispensing cartridge 10 is thus fit for delivering multiple-doses.

Depending on the application, dispensing cartridge 10 can be mounted on container 14 by the manufacturer or consumer. For example, when flowable material 22 is a paste, medicinal fluid or edible substance intended for the general consumer market, cartridge 10 is conveniently factory-installed. Otherwise, the end user can decide when cartridge 10 is required to dispense a particular liquid or fluid.

The construction of dispensing cartridge 10 ensures its operation with materials spanning a wide range of viscosities. Consequently, dispensing cartridge 10 is highly effective and universal. Its contamination-safe operation renders it useful in preserving the purity of virtually any flowable material which is delivered from a container that does not produce an internal vacuum when its contents are expelled.

The construction and materials required to produce dispensing cartridge 10 are low-cost and straightforward to assemble, and the finished product can be easily mounted on or even in any collapsible or reducible container. In the last case, dispensing cartridge 10 can be modified for air-tight seating inside neck 16. The mechanical modifications required are straightforward and easily implemented by a person of average skill in the art.

In the permanently mounted state, dispensing cartridge 10 and container 14 form a highly effective integrated dispensing system. Such system is of great value in dispensing flowable materials intended for domestic or commercial consumption.

That is because the consumer can be offered a ready-to-use product for delivering multiple-doses in a contamination-free manner.

Figure 4:
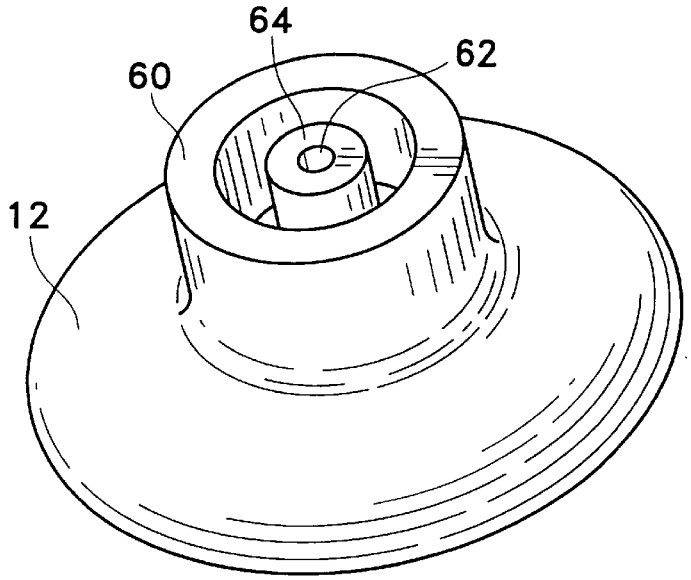
FIG. 4 is a three dimensional view of the tip portion of the cartridge of FIG. 1.

The preferred embodiment of FIGS. 1–3 can be modified in several ways to render it more suitable for specific applications. FIG. 4 illustrates the tip portion of housing 12 with a dispensing port 60. In this case, an outlet valve 62 formed by an end 64 of sheath 44 is completely protected by the high wall of dispensing port 60. This embodiment is more suitable for applications where outlet valve 62 should remain inaccessible from the exterior.

Figure 5:
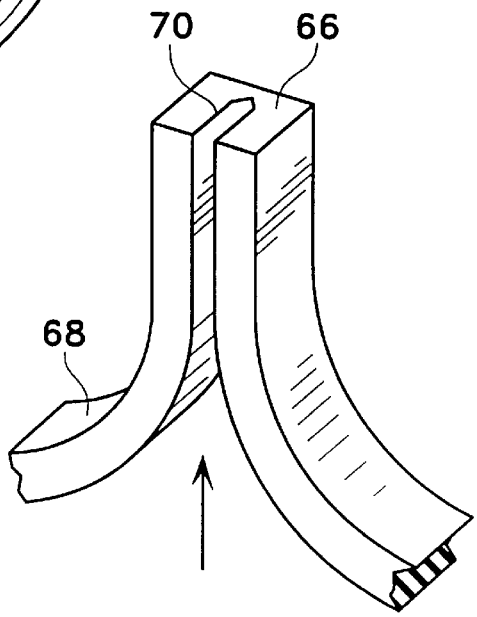
FIG. 5 is a three dimensional view of a portion of the outlet valve.

FIG. 5 affords a more detailed view of an end 66 of a sheath 68 forming an outlet valve 70. In this embodiment, sheath 68 narrows down to a rectangular opening constituting a slit valve. Of course, different shapes of the opening created by end 66 will produce different valves with differing flow characteristics. The three general classes of valves produced by end 66 of sheath 68 include duck bill valves, slit valves and flapper valves. A person with average skill in the art will be able to determine which particular valve type is best suited for the flowable to be delivered and the dispensing conditions.

Figure 6:
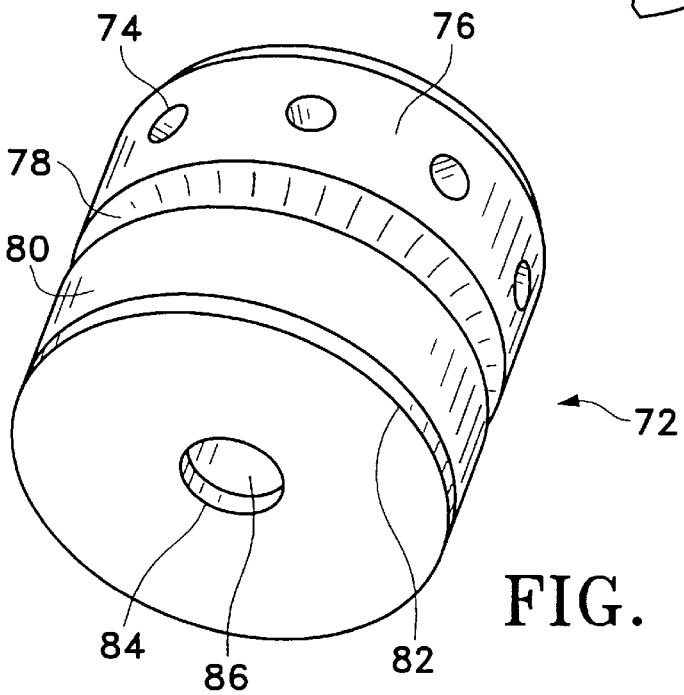
FIG. 6 is a three dimensional view of a delivery block for the cartridge of the invention.

FIG. 6 illustrates a delivery block 72 with numerous output ports 74. In this case, output ports 74 are located circumferentially at equal spacings along a top portion 76 of delivery block 72. Below top portion 76 is located a groove 78 for attaching flexible sheath 44 (not shown). Delivery block 72 has a lower portion 80 and a bottom protective layer 82 for improved contact with neck 16 of container 14. An input port 84 issuing into an internal channel 86 is shown at the bottom of delivery block 72. This particular version of delivery block 72 is well-suited for higher throughput of flowables.

Figure 7:
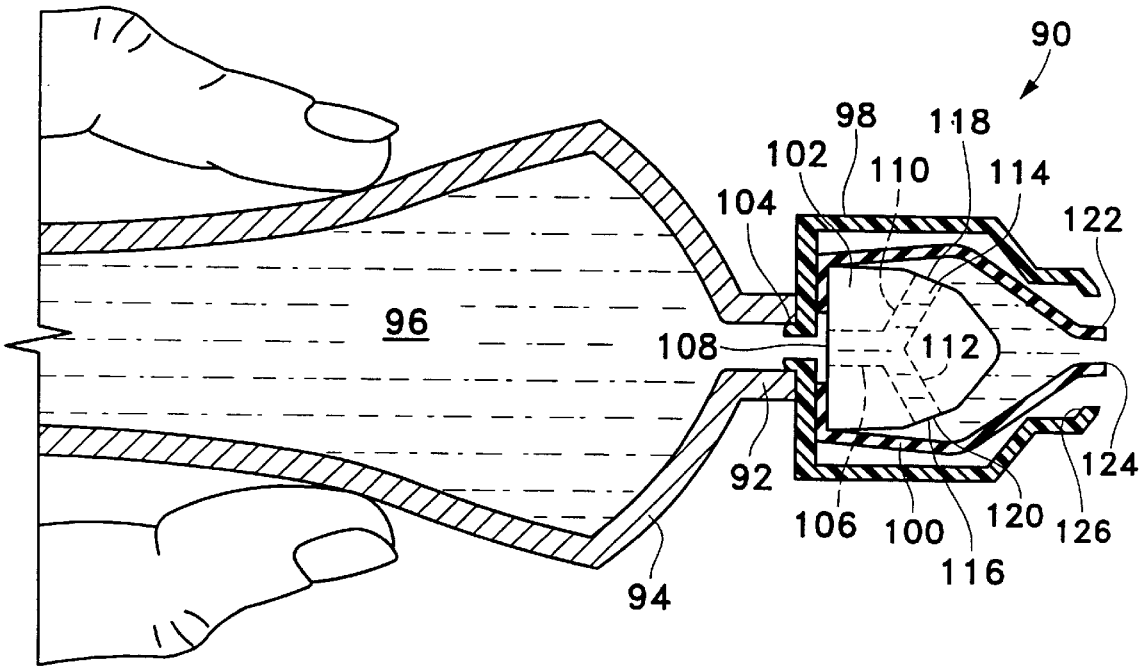
FIG. 7 is a plan sectional view of a dispensing cartridge according to the invention mounted on a tube.

FIG. 7 shows another embodiment of a dispensing cartridge 90 mounted on a neck 92 of a tube 94. This arrangement is designed to dispense a paste 96, e.g., toothpaste. It should be noted that the actual size of dispensing cartridge 90 for mounting on a toothpaste tube would be preferably much smaller.

As in the preferred embodiment, dispensing cartridge 90 has a housing 98 inside which a flexible sheath 100 envelops a delivery block 102. In this embodiment, sheath 100 is fixed by pinching it in an air-tight manner between housing 98 and delivery block 102. The bottom of housing 98 has a press-fit neck 104 which fits inside neck 92 of tube 94. An additional adhesive seal 106, e.g., an adhesive agent, can be provided around press-fit neck 104.

Delivery block 102 has an internal channel 106 which commences an input port 108 and splits into two branches 110 and 112. The latter terminate in output ports 114 and 116, forming two sleeve valves 118 and 120. An end 122 of sheath 100 forms an outlet valve 124. Housing 98 has a dispensing port 126 which protects outlet valve 124 from the external environment.

The operation of this embodiment is analogous to that of the preferred embodiment. In fact, FIG. 7 shows dispensing cartridge 90 in the delivery mode. Sleeve valves 118, 120 and outlet valve 124 are open. Paste 96 is being dispensed from dispensing port 126. The pressure causing paste 96 to be expelled from tube 94, force open sleeve valves 118 and 120, and to be ejected through outlet valve 124, is supplied by the user squeezing tube 94 as shown.

The additional advantage of the embodiment shown in FIG. 7 resides in its simplicity. The pinching of sheath 100 to keep it in place around delivery block 106 is a low-cost solution. Furthermore, the press-fit established between neck 92 and press-fit neck 104 renders this embodiment suitable for pre-mounting of delivery cartridge 90 by the manufacturer.

Figure 8:
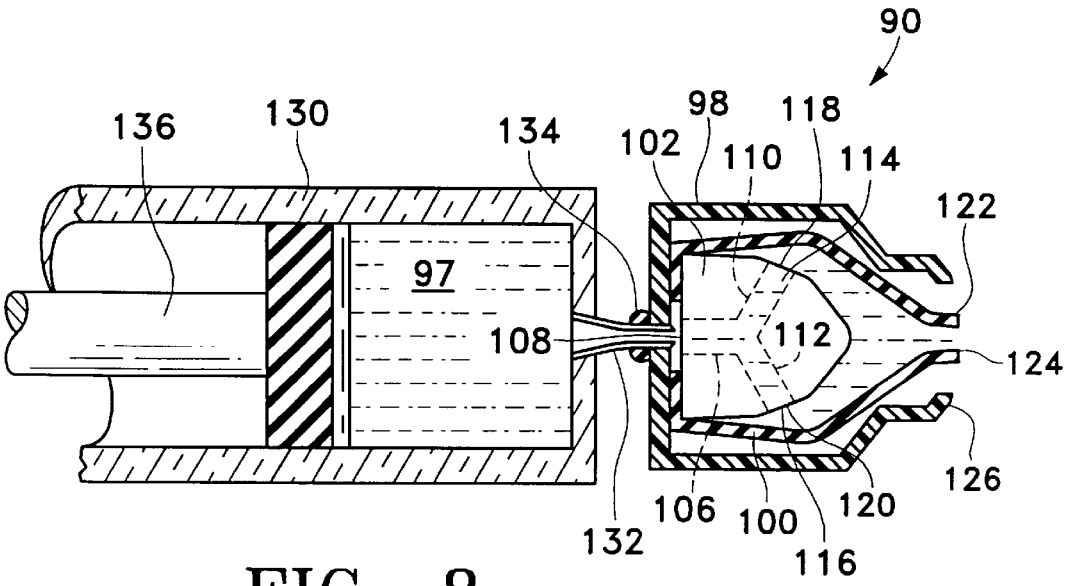
FIG. 8 is a plan sectional view of a dispensing cartridge according to the invention mounted on a syringe.

FIG. 8 shows cartridge 90 of FIG. 7 mounted on a syringe 130. The only difference between the previous embodiment is that cartridge 90 is attached to a neck 132 of syringe 130 by a bonding seal 134. The latter is preferably applied from a dispensing unit (not shown) once cartridge 90 is slid into place on neck 132. The material of the bonding seal can include any adhesive agent or even an epoxide. Alternatively, a heat seal could also be applied, where the bonding material is melted around neck 134. A superior connection is achieved in the event neck 134 is itself made of a plastic or other material which can partially melt together with the bonding material.

During operation the pressure provided by a plunger 136 causes a flowable material 97 to be dispensed by cartridge 90 as described above. This embodiment is well-suited for delivering medicinal fluids in household and hospital settings.

Figure 9:
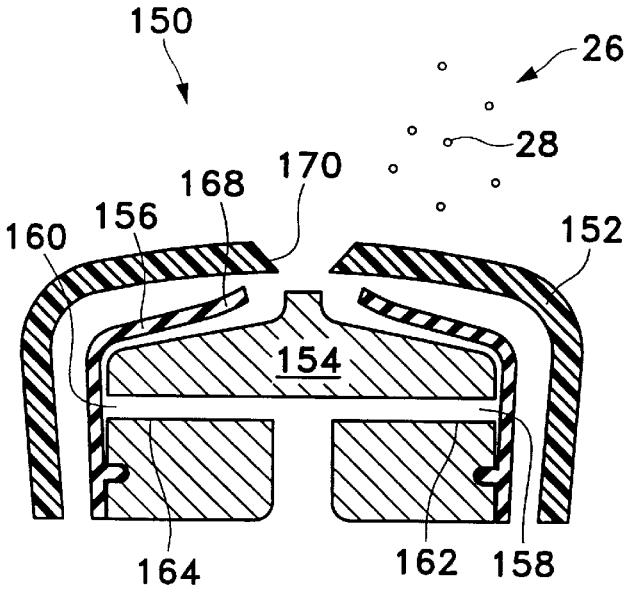
FIG. 9 is a cross sectional view of a dispensing cartridge according to the invention without an outlet valve.

FIG. 9 illustrates yet another embodiment of the invention. Here, a housing 152 of dispensing cartridge 150 holds a delivery block 154 enveloped by a flexible sheath 156. As in the preferred embodiment, two sleeve valves 158 and 160 are formed at output ports 162 and 164 of delivery block 154.

An end 166 of sheath 156 in this embodiment produces an outlet 168. In distinction to the preferred embodiment, however, outlet 168 does not produce a valve. During operation sleeve valves 158 and 160 act as before, and outlet 168 allows all flowable material to exit through a dispensing port 170. After dispensing the flowable sheath 156 constricts tightly around delivery block 154. This action prevents external contaminants 28 from entering the space downstream of sleeve valves 158 and 160 between sheath 156 and delivery block 154. The constricting also expels the remaining flowable from that space. Consequently, the operation of this embodiment is analogous to the preferred embodiment, but does not require the additional outlet valve. Depending on the type of flowable being dispensed and other circumstances, a person with average skill in the art will be able to determine whether this embodiment can be used.

Figure 10:
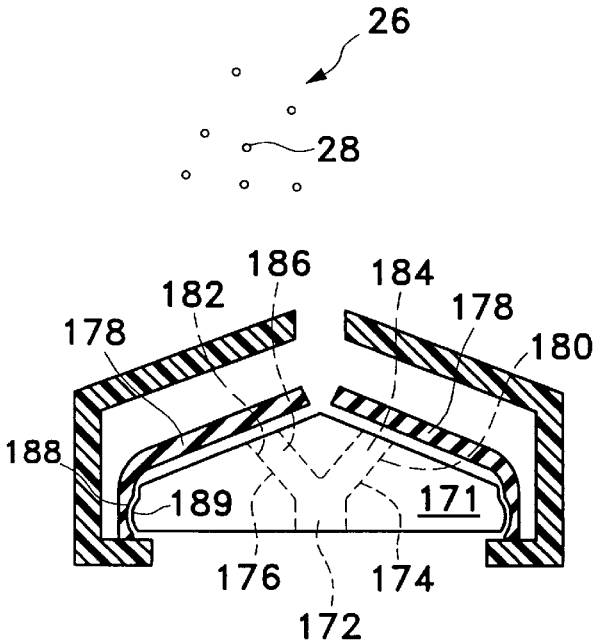
FIG. 10 is a cross sectional view of another dispensing cartridge without an outlet valve.

FIG. 10 shows yet another embodiment of a dispensing cartridge 170 without an outlet valve. In this embodiment branches 174 and 176 of an internal channel 172 form a Y-shape in a delivery block 171. A flexible sheath 178 covers up output ports 180 and 182 producing sleeve valves 184 and 186 respectively. Sheath 178 has a groove 188 for seating a protrusion 189 of delivery block 171. This method of affixing sheath 178 on delivery block 171 is different from the other embodiments where the groove is found in the delivery block.

Figure 11:
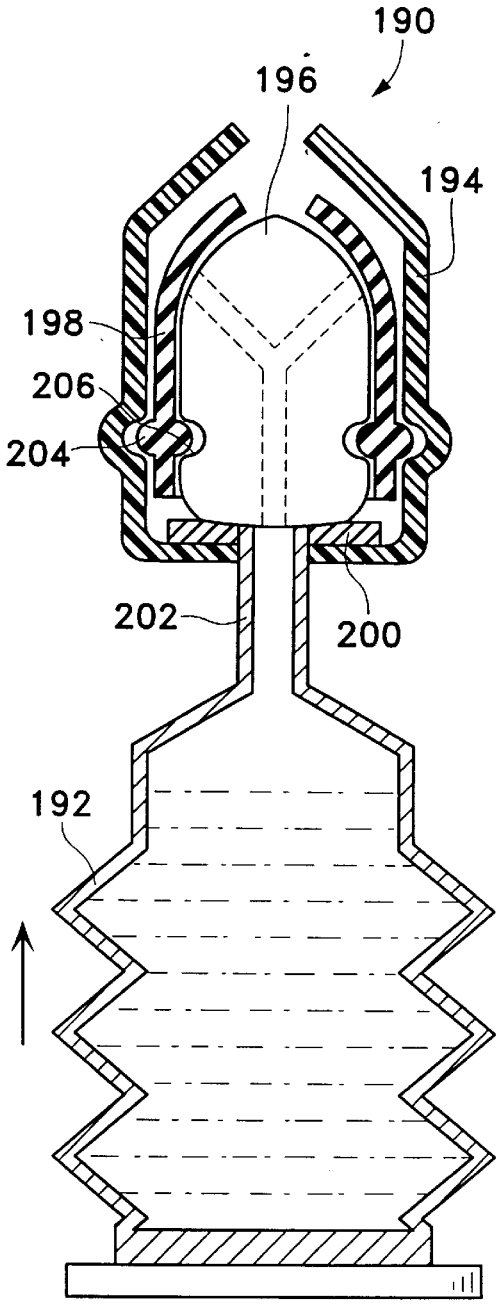
FIG. 11 is a cross sectional view of yet another dispensing cartridge according to the invention mounted on a bellows-type container.

Finally, FIG. 11 shows a dispensing cartridge 190 mounted on a bellows-type container 192. A housing 194 protects a delivery block 196 and a flexible sheath 198 enveloping the former. A seat 200 is provided for mounting delivery block 196 inside housing 194 and for providing an air-tight seal against a neck 202 of container 192.

Sheath 198 has an O-ring 204 and delivery block 196 has a corresponding groove 206 for seating O-ring 204. Attachment of sheath 198 using O-ring 204 is more secure that in the previous embodiments. Therefore, dispensing cartridge 190 is especially well-suited for dispensing flowables under conditions which put a high stress on sheath 198.

It will be appreciated that the foregoing aspects of the invention provide a system for dispensing and delivering a wide range of flowable media including liquids, solutions, mixtures, suspensions, dispersions, lotions, creams, gels and salves. These flowable media can be either volatile or nonvolatile, aqueous or nonaqueous, and classified as inorganic or organic fluids as well as combinations of these. With appropriate selection of materials for the component parts to be used in each specific application, the present invention has application as a dispensing and delivery system for fluids for any industry.

Said dispensing and delivery system advantageously protects said flowable materials from the adverse effects of evaporation, oxidation, and hydrolysis and advantageously prohibits the entry into said flowable media within said dispensing and delivery system of (1) microorganisms such as protozoa, yeast, molds, bacteria, and viruses; or (2) air and one or more of its constituent parts such as nitrogen, oxygen, caron dioxide, and water; or (3) dust, smokes, pollens and filamentous or other particulates; or (4) the evaporation of said flowable material or of one or more of its constituents. Therefore, filters, antimicrobial preservatives, antioxidants and hygroscopic agents are not needed providing for substantial benefits in increased purity of the material, increased ease of formulation, reduction in cost, and a reduction in damaging or harmful side reactions. The effectiveness of the system becomes most apparent from the instant that said system is opened and its first contents are dispensed throughout the period of its use in the marketplace. By continuously maintaining the fluid's purity during delivery of the fluid, the system embodied by this invention enables the distribution of larger-sized containers thereby permitting a reduction in cost per unit volume of the fluid and an economy of scale.

Examples of said flowable materials that can benefit from the present invention include (1) Human and veterinary pharmaceutical preparations, both ethical and over-the-counter products, including eye and lens care solutions; (2) In vitro and in vivo diagnostic agents, (3) Biologicals, (4) Personal care preparations including cosmetics and fragrances, toiletries; products for the care and treatment of skin, hair and nails; shampoos; hair colorants; health and beauty care products; (3) Hot or cold foods, beverages, nutritional supplements and vitamins; (4) Commercial, institutional, laboratory and industrial chemicals, including but not limited to chemical reagents, detergents, photographic solutions, adhesives, paints, varnishes, lubricants and fuels.

Eye & Lens Care Solutions

The use of said dispensing and delivery system enables said flowable media to be reformulated free of preservatives or other protective additives facilitating the therapeutic effect of a human and veterinary pharmaceutical product. For example, it is well known that preservatives can have harmful side effects. Preservatives presently in use in eye and lens care solutions cause toxicity reactions and/or allergic reactions in eye tissues. Preservatives in prescription eye care products are known to adversely affect the post-surgery healing rate of eye tissues. The foregoing aspects of the present invention provide the advantages of a multi-dose system wherein a pharmaceutical agent can be delivered to an enduser without the need for chemical preservatives or other agents required to protect a substance from degradation due to the entry of air and air-borne contaminants.

Industrial Commercial, Institutional & Laboratory Chemicals

The foregoing advantages of the inventions are not limited to pharmaceuticals, but rather provide other benefits in the dispensing of industrial chemical fluids, photographic solutions, soaps and detergents, paints, varnishes, adhesives and the like substances as well. The present system advantageously maintains fluids free from contamination by air, airborne particulates such as dust, fibers, etc. and airborne microbes. Protective filters, antimicrobial preservatives, antioxidants and hygroscopic agents are not needed. Therefore, if handled properly, said dispensing and delivery system provides substantial benefits to a fluid by enabling increased purity, increased ease and efficiency of formulation and production, reduction in cost, and a reduction in harmful side reactions.

Photographic Solutions

The reformulation of photographic development agents without antioxidants, for example would provide substantial benefits in efficiency and in more cost effective formulations. The present system advantageously maintains photographic solutions free from contamination by airborne particulates such as dust, fibers, etc. as well making unnecessary the need for mechanical filters or to add antimicrobial preservatives, antioxidants and hygroscopic agents.

Commercial and Institutional Soaps and Detergents

Cleaners used in institutional and restaurant settings are known to be susceptible to the growth of yeasts and molds, even when preservatives are used. Naturally occurring mutations make some specimens resistant to the action of the preservative resulting in preservative-resistant strains. The foregoing advantages of the present system make the use of preservatives unnecessary providing the needed sanitation and freedom from contamination by microorganisms.

Foods & Beverages

Tomato catsup is an acidic medium and a poor nutrient for the growth of microbes. Therefore it is unnecessary to add preservatives. However, on contact with air tomato catsup oxidizes and turns black. The catsup also evaporates forming unsanitary encrustation around the lip of the container. Edible oils and wines are additional examples of the damaging effects of oxidation on foods and beverages. Oxygen in air causes the oils to turn rancid and the alcohol to oxidize to acetic acid, i.e., vinegar. The foregoing advantages of the system described herein provide the needed protection from evaporation and oxidation required by these foods and beverages.

While the invention has been described in connection with what is presently considered to be the most practical and preferred embodiments, it is to be understood that the invention is not limited to the disclosed embodiments, but on the contrary, is intended to cover various modifications and equivalent arrangements included within the spirit and scope of the appended claims.

For example, there are many other equivalent methods of mounting the dispensing cartridge of the invention on collapsible containers. Adhesives, glues, epoxide-based pastes, mechanical means and any number of other well-known implements are all available for that purpose. The methods for attaching the flexible sheath and distribution of outlet ports on the delivery block also can be provided as desired. Accordingly, persons of ordinary skill in this field are to understand that all such equivalent structures are to be included within the scope of the following claims.

What is claimed is:

1. A dispensing cartridge for dispensing a flowable material from a container of the type which does not produce an internal vacuum when said flowable material is dispensed, and for preventing external contaminants from entering said container, said dispensing cartridge comprising:

a) a housing;

b) an attaching means for attaching said housing to a delivery port of said container in an air-tight manner;

c) a delivery block located inside said housing and having:

1) an input port for receiving said flowable material exiting said container through said delivery port;

2) an internal channel commencing at said input port and terminating in at least one output port;

d) a flexible sheath for enveloping said delivery block such that a portion of said flexible sheath covers said at least one output port thereby producing at least one sleeve valve permitting only the outflow of said flowable material from said at least one output port;

e) an outlet valve formed by an end of said flexible sheath downstream of said at least one sleeve valve, said outlet valve permitting only the outflow of said flowable material therethrough; and f) a dispensing port in said housing for dispensing said flowable material exiting through said outlet valve.

2. The dispensing cartridge of claim 1 wherein said container is selected from the group consisting of tubes, bags, infusion containers, syringes, pouches, collapsible reservoirs, and bellows-type containers.

3. The dispensing cartridge of claim 1 wherein said outlet valve is selected from the group consisting of duck bill valves, slit valves and flapper valves.

4. The dispensing cartridge of claim 1 wherein the inner diameter of said flexible sheath is smaller than the outer diameter of said delivery block such as to produce a tight fit of said flexible sheath on said delivery block.

5. The dispensing cartridge of claim 4 wherein said inner diameter of said flexible sheath in undistended state ranges from 0.5 to 0.8 times said outer diameter of said delivery block.

6. The dispensing cartridge of claim 1 wherein said flowable material is forced to exit said container through said delivery port by the application of external pressure on said container.

7. The dispensing cartridge of claim 1 wherein said flowable material is forced to exit said container through said delivery port by the application of internal pressure on said flowable material inside said container.

8. The dispensing cartridge of claim 1 wherein said flexible sheath is made of a moldable thermoplastic elastomer.

9. The dispensing cartridge of claim 8 wherein said moldable thermoplastic elastomer is selected from the group consisting of styrene-butadiene styrene, silicone, urethane and rubber.

10. The dispensing cartridge of claim 1 wherein said housing is made of a moldable material.

11. The dispensing cartridge of claim 1 wherein said flexible sheath has an attaching means for affixing said flexible sheath to said delivery block below said at least one output port.

12. The dispensing cartridge of claim 11 wherein said means for attaching comprises an O-ring and said delivery block has a groove for seating said O-ring.

13. The dispensing cartridge of claim 11 wherein said means for attaching comprises a protrusion and said delivery block has a groove for seating said protrusion.

14. The dispensing cartridge of claim 11 wherein said means for attaching comprises a groove and said delivery block has a protrusion for seating in said groove.

15. The dispensing cartridge of claim 1 wherein said flexible sheath is pinched in an air-tight manner between said housing and said delivery block below said at least one output port.

16. The dispensing cartridge of claim 1 wherein said external contaminants belong to the group consisting of air, air constituents, oxygen, nitrogen, water vapor, atmospheric gases, air-borne contaminants, smoke, dust, pollen and microorganisms.

17. The dispensing cartridge of claim 1 wherein said housing is rigid such as to arrest the expansion of said flexible sheath and to prevent the abrasion of said flexible sheath as said flowable material is being dispensed through said dispensing port.

18. The dispensing cartridge of claim 1 wherein said at least one output port includes two output ports arranged on diametrically opposite faces of said delivery block.

19. The dispensing cartridge of claim 1 wherein said attaching means is selected from the group consisting of an adhesive seal, a screw-on neck, a press-fit neck, a bonding seal and a heat seal.

20. The dispensing cartridge of claim 1 wherein said attaching means is a permanent bond between said housing and said container, such that said cartridge and said container constitute an integrated dispensing system.

21. A dispensing cartridge for dispensing a flowable material from a container of the type which does not produce an internal vacuum when said flowable material is dispensed, and for preventing external contaminants from entering said container, said dispensing cartridge comprising:

a) a housing;

b) an attaching means for attaching said housing to a delivery port of said container in an air-tight manner;

c) a delivery block located inside said housing and having:

1) an input port for receiving said flowable material exiting said container through said delivery port;

2) an internal channel commencing at said input port and terminating in at least one output port;

d) a flexible sheath for enveloping said delivery block such that a portion of said flexible sheath covers said at least one output port thereby producing at least one sleeve valve permitting only the outflow of said flowable material from said at least one output port;

e) an outlet formed by an end of said flexible sheath downstream of said at least one sleeve valve; and f) a dispensing port in said housing for dispensing said flowable material.

22. The dispensing cartridge of claim 21 wherein said container is selected from the group consisting of tubes, bags, infusion containers, syringes, pouches, collapsible reservoirs, and bellows-type containers.

23. The dispensing cartridge of claim 21 wherein the inner diameter of said flexible sheath is smaller than the outer diameter of said delivery block such as to produce a tight fit of said flexible sheath on said delivery block.

24. The dispensing cartridge of claim 23 wherein said inner diameter of said flexible sheath in undistended state ranges from 0.5 to 0.8 times said outer diameter of said delivery block.

25. The dispensing cartridge of claim 21 wherein said flowable material is forced to exit said container through said delivery port by the application of external pressure on said container.

26. The dispensing cartridge of claim 21 wherein said flowable material is forced to exit said container through said delivery port by the application of internal pressure on said flowable material inside said container.

27. The dispensing cartridge of claim 21 wherein said flexible sheath is made of a moldable thermoplastic elastomer.

28. The dispensing cartridge of claim 27 wherein said moldable thermoplastic elastomer is selected from the group consisting of styrene-butadiene styrene, silicone, urethane and rubber.

29. The dispensing cartridge of claim 21 wherein said housing is made of a moldable material.

30. The dispensing cartridge of claim 21 wherein said flexible sheath has an attaching means for affixing said flexible sheath to said delivery block below said at least one output port.

31. The dispensing cartridge of claim 30 wherein said means for attaching comprises an O-ring and said delivery block has a groove for seating said O-ring.

32. The dispensing cartridge of claim 30 wherein said means for attaching comprises a protrusion and said delivery block has a groove for seating said protrusion.

33. The dispensing cartridge of claim 30 wherein said means for attaching comprises a groove and said delivery block has a protrusion for seating in said groove.

34. The dispensing cartridge of claim 21 wherein said flexible sheath is pinched in an air-tight manner between said housing and said delivery block below said at least one output port.

35. The dispensing cartridge of claim 21 wherein said external contaminants belong to the group consisting of air, air constituents, oxygen, nitrogen, water vapor, atmospheric gases, air-borne contaminants, smoke, dust, pollen and microorganisms.

36. The dispensing cartridge of claim 21 wherein said housing is rigid such as to arrest the expansion of said flexible sheath and to prevent the abrasion of said flexible sheath as said flowable material is being dispensed through said dispensing port.

37. The dispensing cartridge of claim 21 wherein said at least one output port includes two output ports arranged on diametrically opposite faces of said delivery block.

38. The dispensing cartridge of claim 21 wherein said attaching means is selected from the group consisting of an adhesive seal, a screw-on neck, a press-fit neck, a bonding seal and a heat seal.

39. The dispensing cartridge of claim 21 wherein said attaching means is a permanent bond between said housing and said container, such that said cartridge and said container constitute an integrated dispensing system.

* * * * *